US005308270A

United States Patent [19]

Travor et al.

[11] Patent Number: 5,308,270

[45] Date of Patent: May 3, 1994

[54] ICE PENETRATING BUOY

[75] Inventors: Bruce W. Travor, Holland; Ronald D. DiGirolamo, Churchville, both of Pa.

[73] Assignee: The United Stated of America as represented by the Secretary of the Navy, Washington, D.C.

[21] Appl. No.: 53,763

[22] Filed: Apr. 15, 1993

[51] Int. Cl.[5] ..... B63B 21/52

[52] U.S. Cl. ..... 441/21; 175/18

[58] Field of Search ..... 441/1, 2, 6, 7, 21, 441/22, 32, 33; 102/411; 175/18; 367/36, 145

[56] References Cited

U.S. PATENT DOCUMENTS 3,628,205 12/1971 Starkey et al. ..... 441/25
4,966,079 10/1990 Humphrey ..... 102/411
5,246,078 9/1993 Kryger et al. ..... 175/18

*Primary Examiner*—Jesus D. Sotelo
*Attorney, Agent, or Firm*—James V. Tura; James B. Bechtel; Susan E. Verona

[57] ABSTRACT

A submarine-launched, ice-penetrating sonobuoy is disclosed. The buoy is torpedo-shaped with a collapsible obturator tail-fin section removably attached at the tail-end, standard electronics in a mid-section and an explosive nose cone at the front. Immediately after launch, the tail-fin section expands to exert a drag on the buoy to halt any forward motion. The tail-fin section is discarded and the nose cone and mid-section portion rise until the nose impacts the underside of the ice. Upon impact, a pre-selected "shape" charge ruptures the ice and an a spring-antenna, connected to the mid-section, is raised through the hole.

9 Claims, 5 Drawing Sheets

FIG. 1
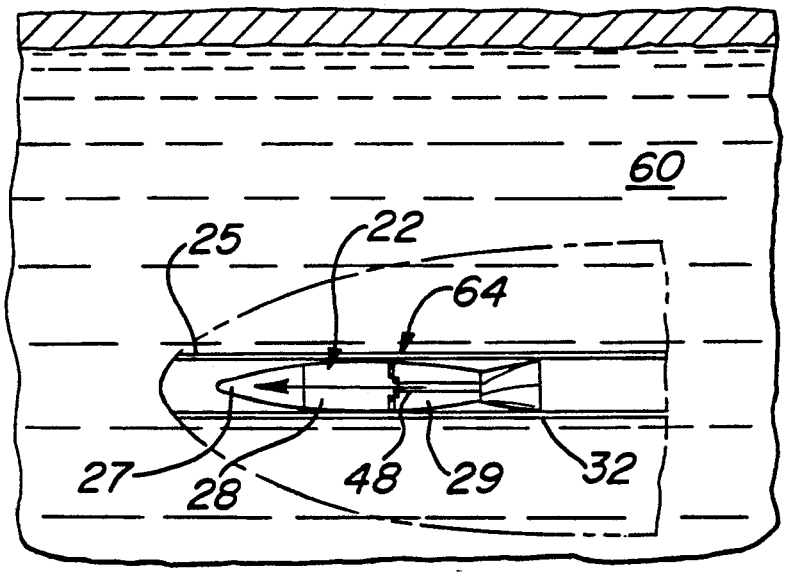
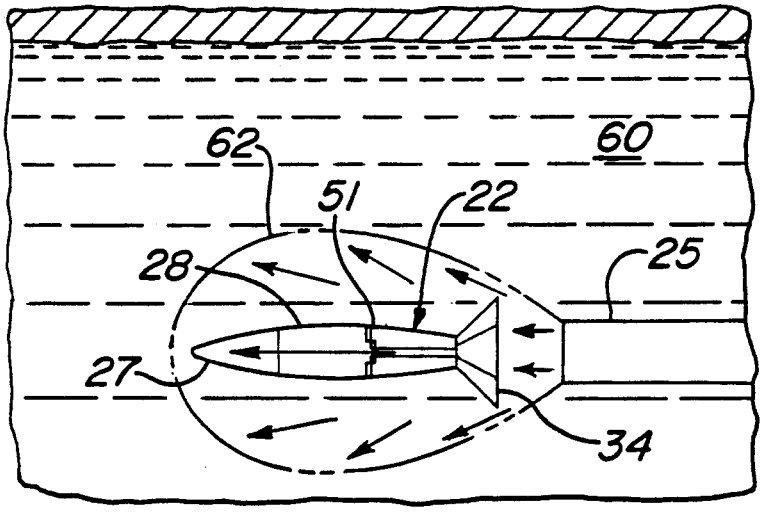
FIG. 5
FIG. 6
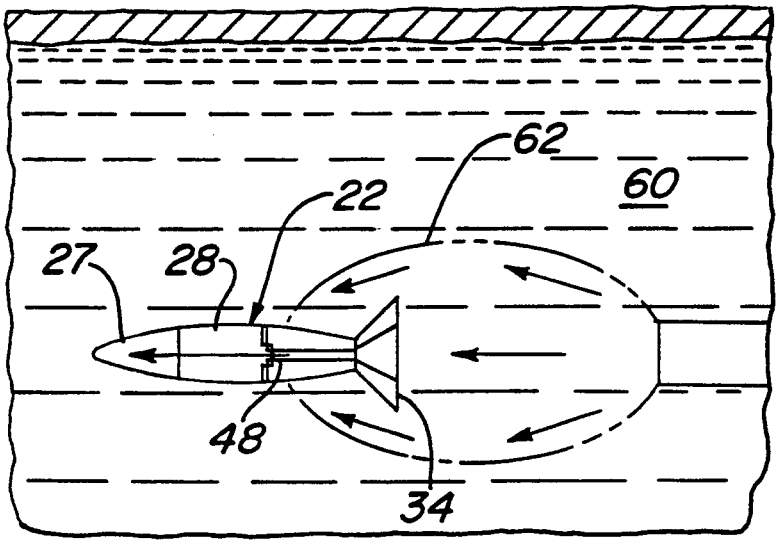

FIG. 2
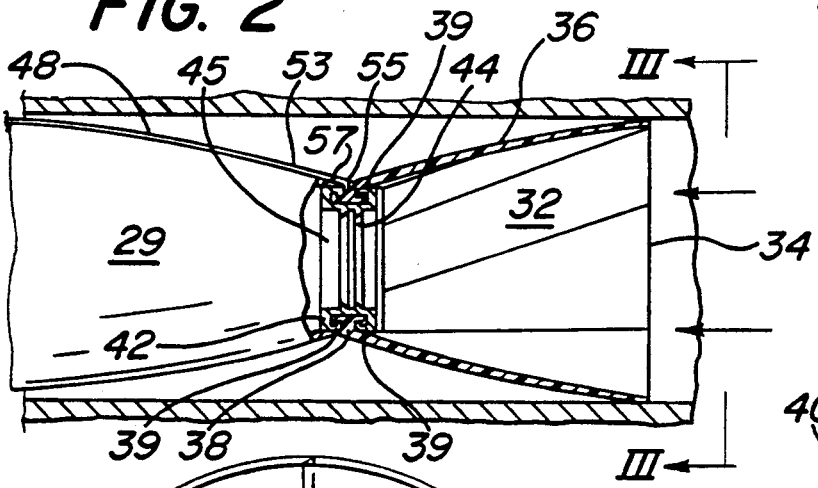
FIG. 4
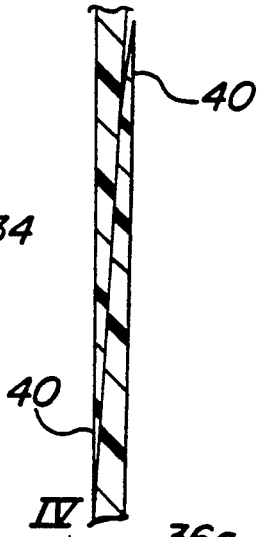
FIG. 8
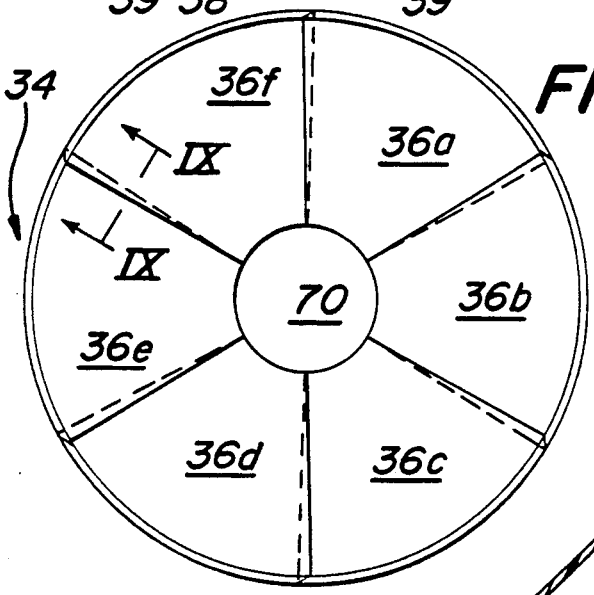
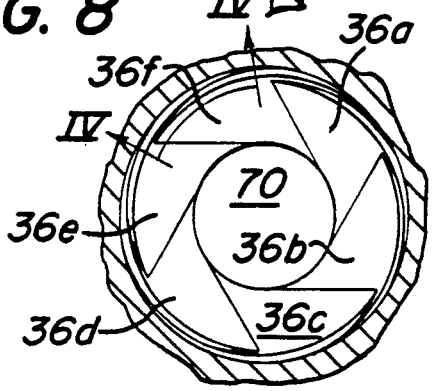
FIG. 3
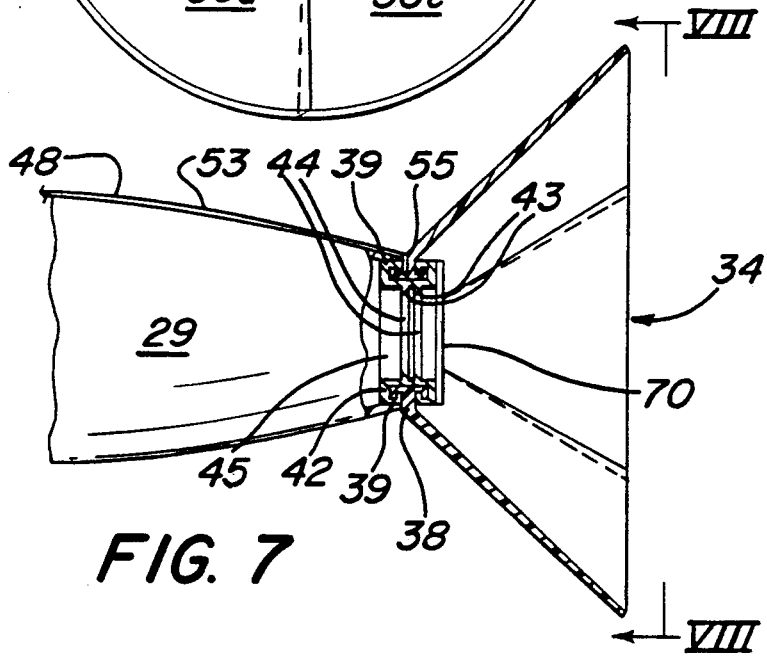
FIG. 7
FIG. 9
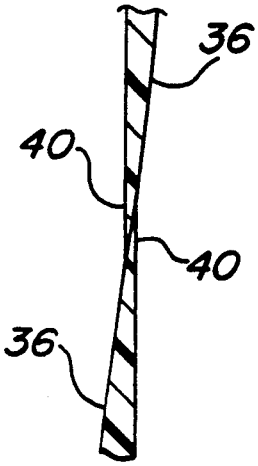

ICE PENETRATING BUOY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

There is always a need, in underwater surveillance, for the data-gathering buoy to establish "air" contact; that is, be able to raise an antenna to allow signal transmission to, or receipt from, an aircraft overhead. In many of the extreme northern or southern parts of the globe, this is almost always difficult due to the thin ice covering (6–18 inches) over the water. The surest way to "plant" a buoy is to send someone out onto the ice to drill a proper-sized hole and manually deploy the system. This method does have many weak points, such as the amount of labor and time necessary and the safety of the crewman to name a few. Buoys launched from the air may not ever deploy through the ice, from the top down, and, until the instant invention, buoys launched from beneath the ice would either fail to break through or damage sensitive components in a powered attempt (such as when submarine launched) to do so.

SUMMARY OF THE INVENTION

Accordingly, it is an object of the present invention to provide an ice-penetrating sonobuoy that can be launched from under the ice, will open a hole in the ice and will erect an antenna through said hole.

It is another object of the present invention to provide a submarine-launched, ice-penetrating sonobuoy that uses an expanding tail-fin section to halt forward lateral movement in the water.

It is still another object of the present invention to provide a submarine-launched sonobuoy that employs a shaped charge in the nose cone section to rupture a hole in the ice.

These and other objects and many attendant advantages of the present invention are obtained where a submarine-launched, torpedo-shaped sonobuoy has, at its front end, an explosive nose cone, and at its rear end, an expandable obturator tail-fin section, with standard sonobuoy components packaged into a mid-portion. The tail-fin section is made out of six fins each made from a strong but flexible, molded, silicon-based rubber. The fins are constricted to the diameter of the buoy by the size of the launch tube while the buoy is being fired, but once free, spread open to a larger, fan-shaped deployment to act as a retardation device against further forward, lateral motion. Once the buoy has cleared the launch tube and forward motion of the buoy has been virtually halted, a restraining mechanism opens and allows separation of a lower electronics section and the heavier tail section. After separation of these two sections, the relatively buoyant nose cone section and upper electronics section ascend to impact under the ice. Upon impact, a detonator triggers a shaped charge therein, which charge concentrates an explosive force through the ice to make an opening. A spring-loaded antenna is deployed through the opening and the buoy begins operation.

The novel features which are believed to be characteristics of the invention, both as to its organization and methods of operation, together with further objects and advantages thereof, will be better understood from the following descriptions in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 1 shows a pictorial depiction of the first stage of deployment of an ice-penetration buoy as it travels through a launch chamber, such as in a submarine (not shown);

FIG. 2 shows an isolated and enlarged side view of the expandable obturator in its closed, or collapsed, launch position as it is attached to the tail-end section of the buoy of FIG. 1;

FIG. 3 shows an end view of the obturator of FIG. 2 as taken along lines III—III of FIG. 2;

FIG. 4 shows a cross-section view of two of the obturator fins to show fin overlap when fully closed, as taken along lines IV—IV of FIG. 3;

FIG. 5 shows a pictorial depiction of the next stage of deployment of the buoy showing the buoy immediately after it has exited the launch tube;

FIG. 6 shows a pictorial depiction of the next stage of buoy deployment, showing the buoy passing through the launch air bubble that accompanies a submarine launch underwater;

FIG. 7 shows an isolated and enlarged side view of the expanded obturator of the buoy of FIG. 6;

FIG. 8 shows an end view of the obturator of FIG. 7 as taken along lines VIII—VIII of FIG. 7;

FIG. 9 shows a cross-sectional view of the slight overlap of two of the tip ends of obturator fins as taken along lines IX—IX of FIG. 8;

DESCRIPTION OF THE PREFERRED EMBODIMENT

Figure 10:
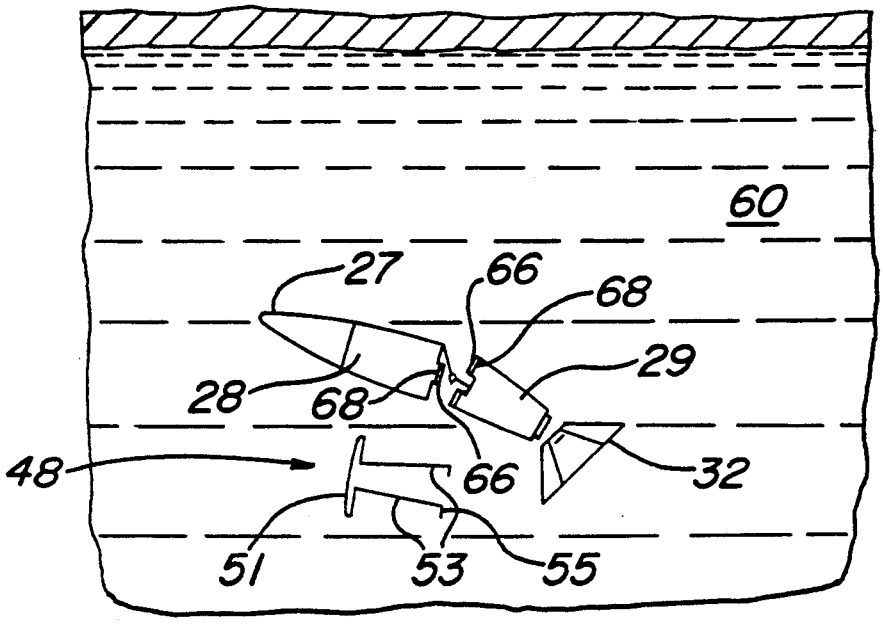
FIG. 10 shows a pictorial depiction of the release of the retainer spring holding the lower electronics section and tail fin section to the upper electronics section.

Referring now to the drawings, wherein like reference characters designate like or corresponding parts throughout the several views, there is illustrated in FIG. 1 a pictorial depiction of the first stage of deployment of an ice-penetrating buoy 22 as it is launched from the buoy-launch tube 25 of a submarine (not shown), as is normal procedure in the industry. Buoy 22 is about 5 inches in diameter and generally has an overall cigar shape and has a nose cone 27, an upper, buoyant, electronics package section 28 and a lower electronics package section 29, as will be further explained below, all removably joined together to a tail section 32. Buoy 22 has an overall length of about 22 inches. FIGS. 2 through 9 all show further details of the tail section and how it functions during buoy launch, then springs open to act as a large net to almost completely stop any forward motion and, finally, how it falls away when no longer needed.

FIG. 2 shows an isolated and enlarged side view of the tail end of buoy 22, showing expandable obturator 34 in its compressed launch state. FIG. 7 is an isolated and enlarged side view of the tail end of buoy 22, showing expandable obturator 34 in its expanded position. Obturator 34, as seen in end views while compressed (FIG. 3) and when expanded (FIG. 8) is made from a combination of eight flexible, silicon rubber fins 36*a–f*.

Fins 36 are each constructed in the general shape of an arcuate section of a circle, as can be seen in FIG. 8. The silicone rubber used has a durometer of about 20. At the smaller, base area of each fin is an obturator securing means, in the form of a molded T-section 38, that can resist launch pressures of up to 2,000 to 3,000 p.s.i. In this base area, the thickness of the rubber is approximately 0.200 inches and, each fin is tapered from base 38 out to the tip 40, where the thickness is around 0.060 inches. Each fin has sculptured, opposite-sided contours to allow fin overlapping, as seen in FIGS. 4 and 9. Each section 38 is fitted into the open area between flanges 39 around the periphery of an obturator securing ring 42 that is fitted inside the hollow end of package section 29 (as seen in FIGS. 2 and 7). Securing ring 42 is a hollow ring piece that has, on its inner surface, ridges 43 that contain anchor weights 45. Anchor weights 45 are attached by cable 46 (not shown in FIGS. 2 or 7) to the other standard sonobuoy components such as sensor 47 (see FIG. 11) inside lower electronics package 29. Silicone rubber is used for the fins to take advantage of its "memory" characteristics in that, as will be explained, fins 36 can be compressed to fit into the relatively narrow circumference of launch-tube 25, and, when free after launch, will spring back to their original shape.

Tail section 32 and lower electronics package 29 are also bound together by a retainer spring 48 made from spring steel wire. As shown in FIG. 10, a pictorial depiction of the release of the retainer spring holding lower electronics section 29 and tail section 32 to upper electronics section 28, spring 48 is comprised of a hoop portion 51, that encircles the outer circumference of the junction of the upper and lower electronic sections, and a pair of elongated fingers 53. As will be explained, once buoy 22 emerges from launch tube 25, the tip ends 55 of fingers 53 are able to spring free from their retainer sockets 57, thereby releasing tail end 32.

The first steps of the launch sequence of buoy 22, as depicted in FIGS. 1, 5 and 6, starts with loading the compressed buoy 22 into launch tube 25. As is known, buoy 22 is stored inside a flexible sleeve (not shown) that restricts hoop 51 and fingers 53 from any movements and maintains fins 36 in their compressed position. The sleeve is removed from buoy 22 as it gets loaded into launch tube 25, and the tube is securely closed and latched.

At buoy launch, pressures of approximately 2,000 to 3,000 p.s.i. are exerted against tail section 32 (FIG. 1). Because of the contoured overlapping and tapered design of fins 36, fins 36 will flex out against the inside wall of tube 25, to form a concave shell, to trap the pressurized gas. FIG. 5 shows a depiction of a side view of buoy 22 as it exits launch tube 25 and transitions into open water 60 and is immediately surrounded by a gas bubble 62. Now, the "memory" qualities of silicon rubber cause fins 36*a–f*, once they are free from the restriction of launch tube 25, to restore to their original shape and "fan" out as like so many playing cards to form expanded obturator 34. At this time, expanded obturator 34 acts first as a sail to accelerate buoy 22 through a transitional velocity region of gas bubble 62 and then as a dragnet to slow buoy 22 down once it gets into open water. Of course, the size of bubble 62 will depend on the depth below the surface where buoy 22 is launched. As seen in FIG. 6, buoy 22 passes out of gas bubble 62, and the pressure effects thereof, and into open water 60 with some forward velocity.

With the emergence of buoy 22 from within launch tube 25, a major reaction now starts to take place. With no restrictions on it, retainer spring 48 attempts to open up. As seen in FIG. 2, fingers 53 have been forced to conform to the exterior outline of section 29, and the tops 55 placed into retainer sockets 57 in obturator retaining ring 42. The spring action of fingers 53 will cause them to attempt to straighten out, thus removing tips 55. The side-by-side location of retainer sockets 57 keeps fingers 53 secured immediately adjacent one-another, and this positioning, as well as the restriction of launch tube 25, maintains hoop portion 51 tightly wrapped around the circumference of junction 64 between sections 28 and 29. At junction 64, each common end of sections 28 and 29 is constructed with extending tabs 66, with each tab having a groove 68 pressed into the outer surface to seat hoop portion 51 (see FIG. 10). Once buoy 22 completely emerges from launch tube 25, the restriction on fingers 53 and hoop 51 is removed and the spring force therein urges the hoop to spread open and become unseated from groove 68. As soon as this happens, section 28 then is no longer held in place adjacent section 29 and can separate. This will occur naturally due to the buoyant nature of section 28 as compared to the heavier-than-water nature of section 29. In addition, since obturator securing ring 42, with the release of tip ends 55 out of sockets 57, no longer has a solid connection to lower electronics package 29, expanded obturator 34 will simply fall away due to the larger drag force being exerted on fins 36. Also, a retainer plate 70, in the form of a circular disk, that had been trapped by the previously compressed fins, is able to fall away and allow weight 45 and sensor 47 to be discharged through the rear end of package 29.

Figure 11:
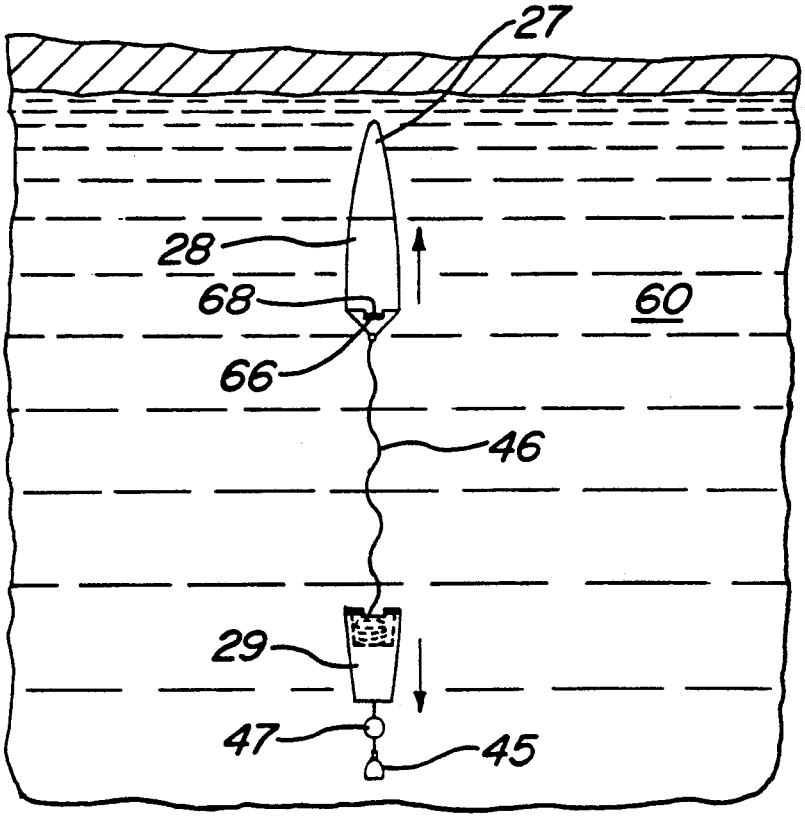
FIG. 11 shows a pictorial depiction of a side view of the nose cone and upper electronics package close to impact with the underside of the ice.
Figure 12:
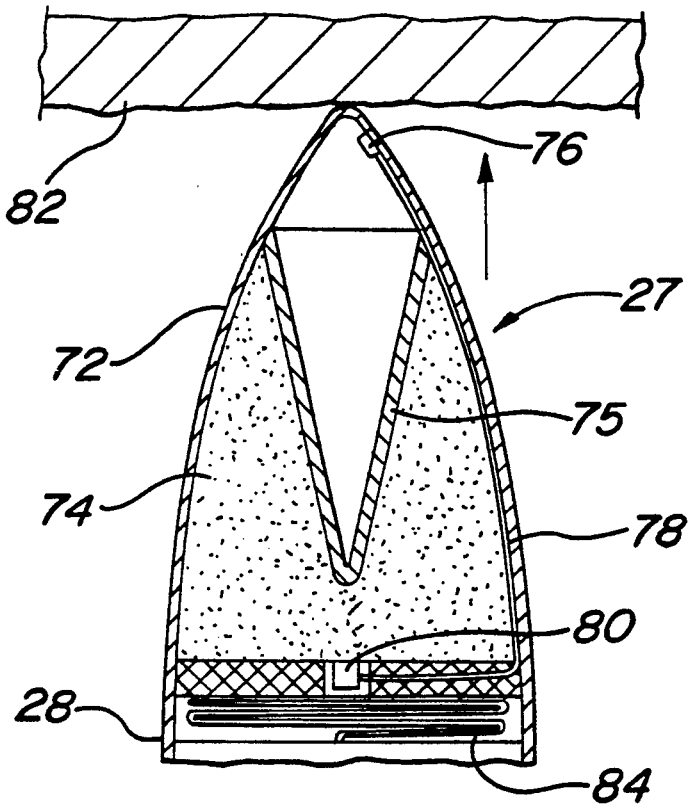
FIG. 12 shows an isolated and enlarged cross-sectional view of the nose cone impacting the underside of the ice.
Figure 13:
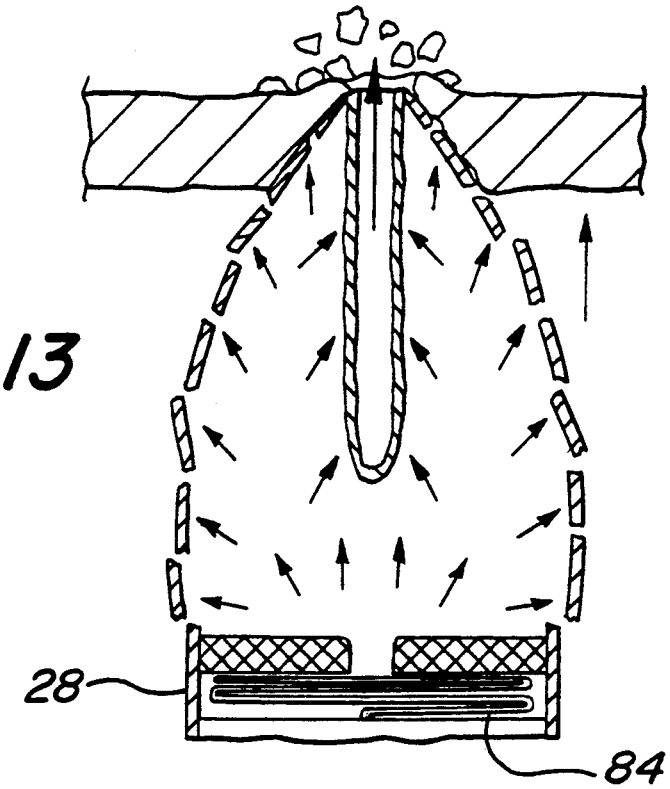
FIG. 13 shows a pictorial depiction of the first stage of explosion of the shaped charge in the nose cone.
Figure 14:
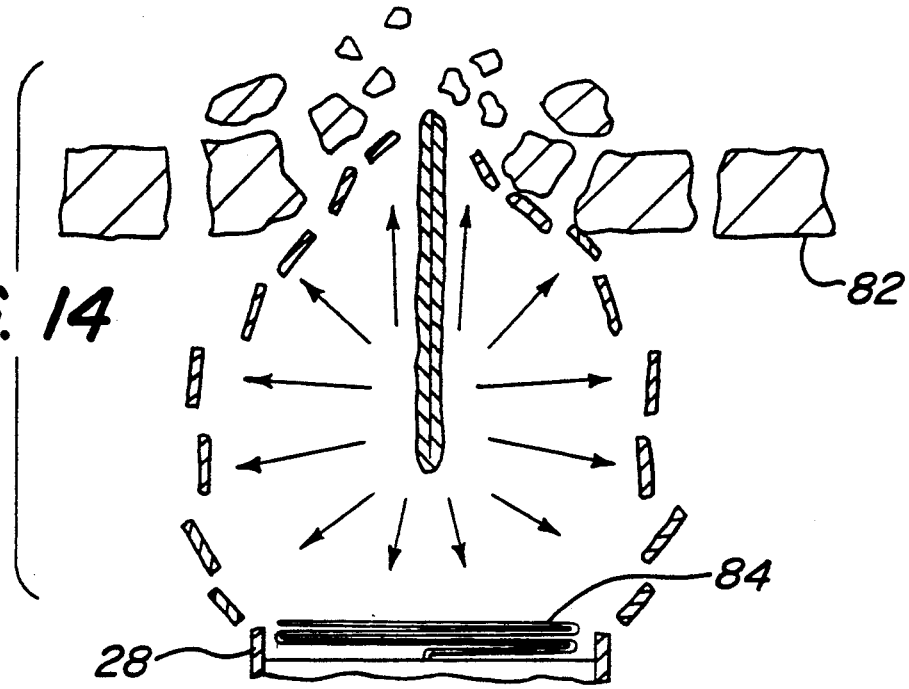
FIG. 14 shows a pictorial depiction of the final stage of explosion of the shaped charge.
Figure 15:
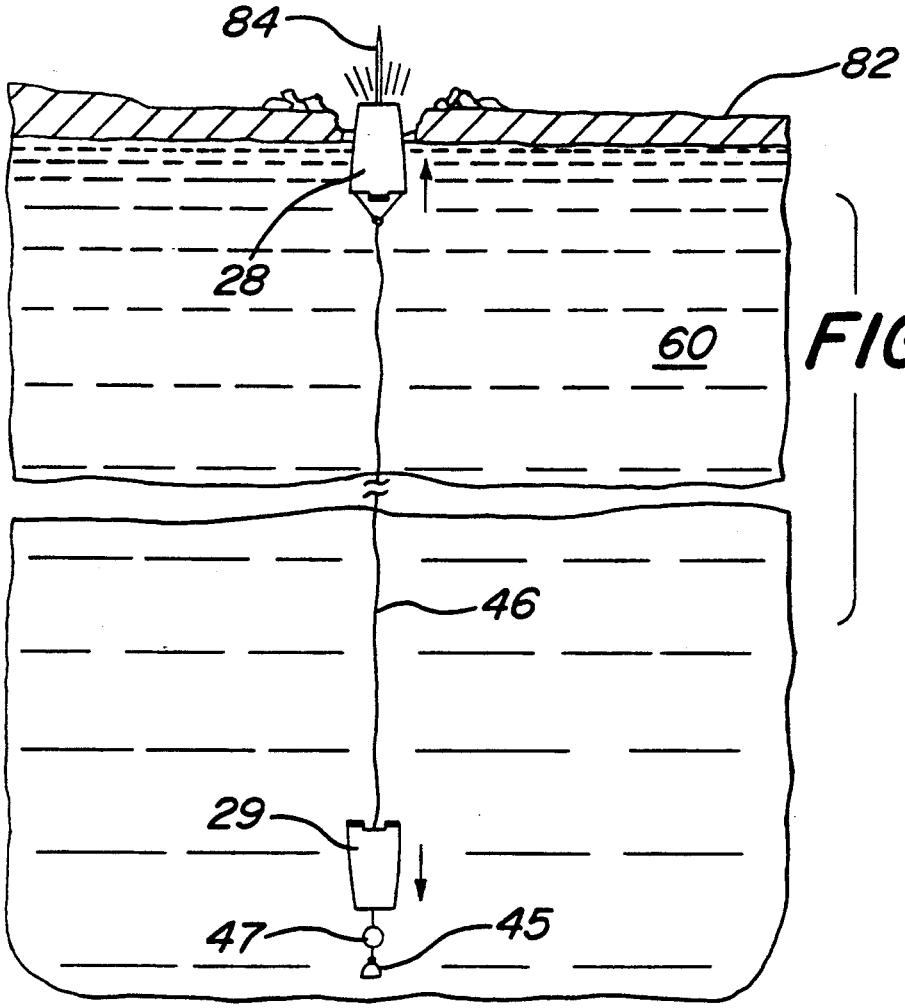
FIG. 15 shows a pictorial depiction of the fully deployed buoy with an antenna protruding through the hole in the ice.

FIGS. 11–15 shows the final steps of movement of nose cone 27 and upper electronics package 28. Both of these sections are manufactured to be lighter than seawater, or buoyant, out of materials and by means known in the art, and, as seen in FIG. 11, will immediately start to rise once free of the heavier package 29. Nose cone 27 is made from a thin steel skin 72 containing a shaped charge of high explosive 74. An internal copper cone 75 shapes the charge. A piezoelectric element 76, as used in the industry, is fastened to the tip end of the nose, on the inside thereof, and is connected by wire 78 to a fuze 80. Upon impact with the underside of the ice 82, piezoelectric element 76 is crushed and the electric impulse causes fuze 80 to detonate. This, in turn, detonates explosive 74, which causes copper cone 75 to collapse (see FIG. 13). This, in turn, creates a focused, high velocity shock wave that, as shown in FIG. 14, ruptures a hole through the ice 82. Once the explosion occurs, a spring-wire antenna 84 is no longer trapped in its folded position and is able to spring out to stand through the ice. Buoy 22 has now made air contact and can function as designed.

Finally, while the ice penetrating buoy has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

What we claim is:

1. A submarine-launched buoy capable of decelerating immediately after launch, ascending beneath an ice flow, rupturing an opening in said flow and erecting an antenna in said opening, comprising:

a slender, buoy body having a front end and a rear end and with expandable tail-fin means to resist launch pressure and to decelerate the buoy removably attached to the rear end; and wherein said body has at least one rearward-most section and at least one forward-most section for holding detection and communication means, said rearward-most section and said forward-most section being substantially in the shape of right circular cylinders separatable at a common, joined surface, and a nose cone section having explosive means therein joined to the forward-most section.

2. A buoy as described in claim 1 wherein said tail-fin means comprises a plurality of individual fins, each substantially in the shape of an arcuate section of a circle, and fixed into an obturator securing means.

3. A buoy as described in claim 2 wherein said obturator securing means comprises a hollow ring having opposed flanges around the outer surface thereof.

4. A buoy as described in claim 1 wherein each said fin is substantially thicker at a base thereof than at a tip end thereof.

5. A buoy as described in claim 2 wherein each said fin is made from a silicone rubbery material having a durometer of at least 20.

6. A buoy as described in claim 1 wherein said explosive means includes a piezoelectric element connected to a fuze at the base of said explosive means.

7. A buoy as described in claim 6 wherein said explosive means further includes a copper cone to direct the charge.

8. A buoy as described in claim 1 wherein said forward-most section contains a spring antenna.

9. A submarine-launched buoy capable of decelerating immediately after launch, ascending beneath an ice flow, rupturing an opening in said flow and erecting an antenna in said opening, comprising:

a slender, buoy body having a front end and a rear end, holding upper and lower electronics sections therebetween, and with a tail fin section removeably fixed to the rear end, said tail-fin section comprised of a plurality of individual, arcuate sections of a circle, each being fixed at a base thereof into a ring and tapering to a thin, tip end;

a nose cone section containing a high explosive and having a piezoelectric element at the tip end thereof connected to a detonating fuze at the base thereof; and a spring antenna contained in said upper electronics section.

* * * * *